US005299688A

United States Patent [19]

McKay et al.

[11] Patent Number: 5,299,688

[45] Date of Patent: Apr. 5, 1994

[54] STORAGE DEVICE AND SYSTEM FOR CARD COLLECTIONS

[75] Inventors: John W. McKay; Brian W. McKay, both of Keller, Tex.

[73] Assignee: Pro Box, Fort Worth, Tex.

[21] Appl. No.: 855,230

[22] Filed: Mar. 20, 1992

[51] Int. Cl.[5] ..... B65D 25/06

[52] U.S. Cl. ..... 206/425; 220/23.4; 220/533

[58] Field of Search ..... 206/315.11, 425, 594; 220/23.4, 532, 533, 553, DIG. 6

[56] References Cited

U.S. PATENT DOCUMENTS

| | | | |
|---|---|---|---|
| 1,221,631 | 4/1917 | Trout | 220/532 |
| 1,465,827 | 8/1923 | Kunkel | 206/425 |
| 2,347,192 | 4/1944 | Grice | 220/553 |
| 2,610,759 | 9/1952 | Slade | 220/553 |
| 3,334,767 | 8/1967 | Cornelius et al. | 220/DIG. 6 |
| 3,429,653 | 2/1969 | Brett | 206/594 |
| 3,554,429 | 1/1971 | Cohen | 220/532 |
| 4,328,902 | 5/1982 | North | 220/23.4 |
| 4,505,388 | 3/1985 | Solomon | 206/425 |
| 4,729,475 | 3/1988 | Kurkjian | 206/425 |
| 4,744,614 | 5/1988 | Gombosi | 206/315.11 |
| 5,007,540 | 4/1991 | Beasley | 220/23.4 |

*Primary Examiner*—Jimmy G. Foster

*Attorney, Agent, or Firm*—Winstead Sechrest & Minick

[57] ABSTRACT

There is disclosed a storage device for sports card collections and the like. The storage compartment within the device is widened at the top to allow removal of individual cards and, in one embodiment, is partitioned by removable dividers which are firmly held in place by opposing guides formed within the sides of the storage box. The dividers may be arranged in any desired order resulting in various combinations of storage space between such dividers. A lid can be provided to firmly enclose the stored cards and a number of the storage boxes may be interlocked in a side-by-side manner to expand the card storage capacity.

15 Claims, 2 Drawing Sheets

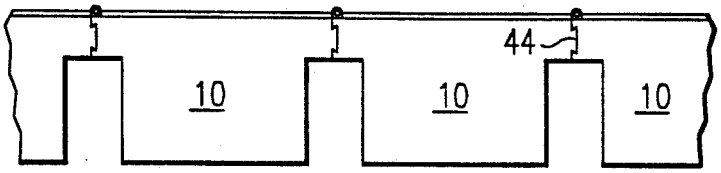
FIG. 3
FIG. 1
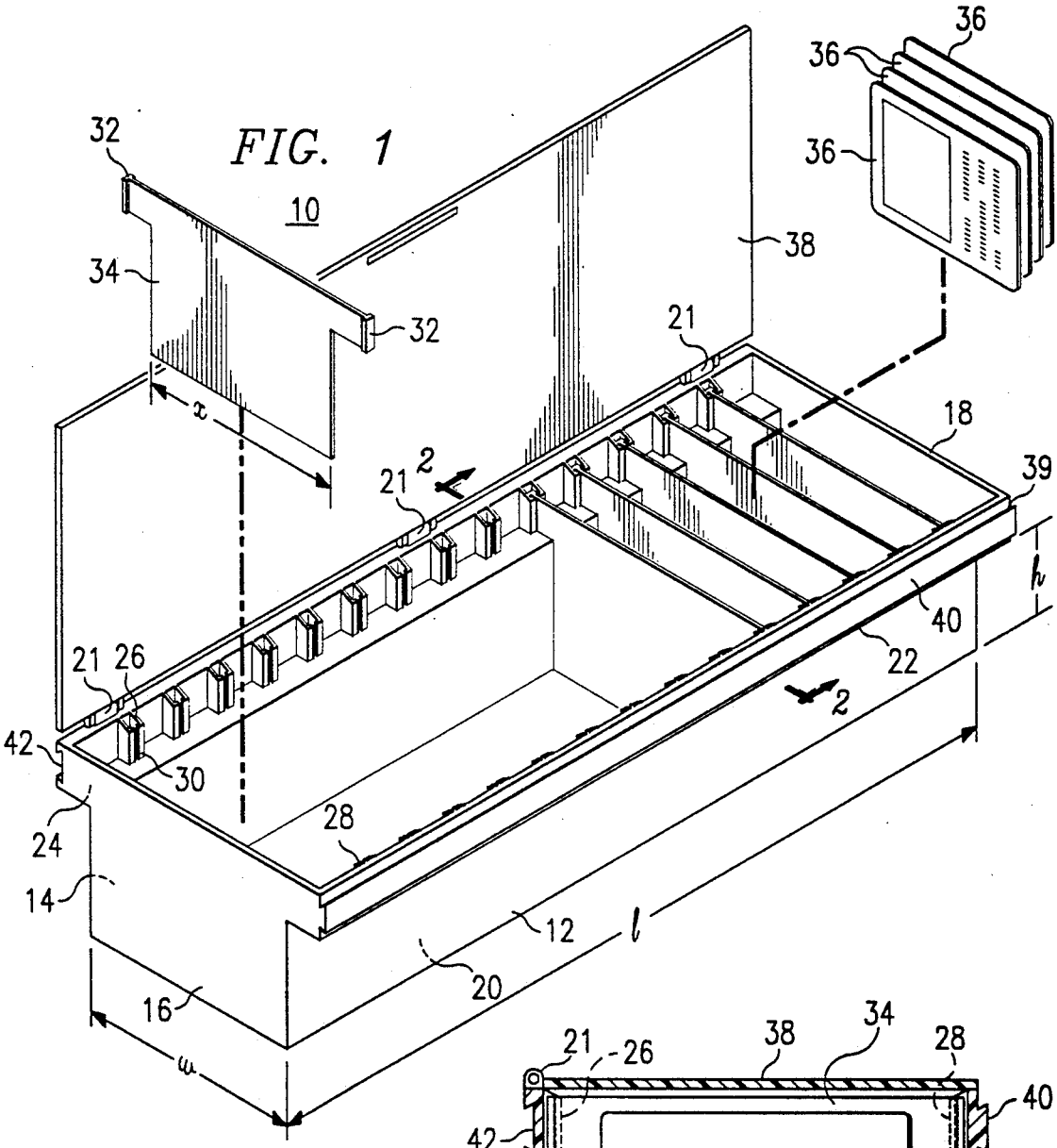
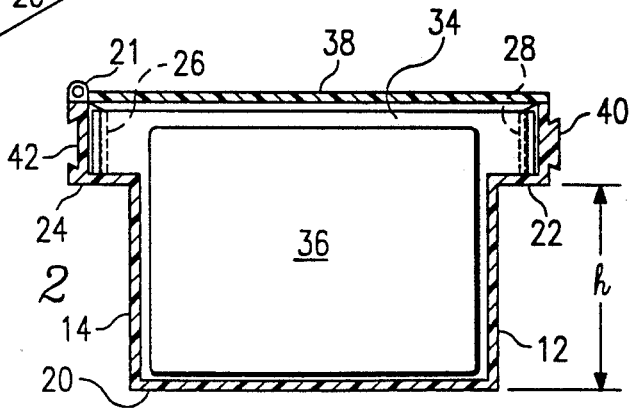
FIG. 2

STORAGE DEVICE AND SYSTEM FOR CARD COLLECTIONS

TECHNICAL FIELD OF THE INVENTION

This invention relates to card collection storage devices and more particularly to a box for storing sports cards where individual cards are easily removed and where the cards are maintained in place without damage.

BACKGROUND OF THE INVENTION

Sports card collections such as baseball cards have become a major investment vehicle. No longer is collecting baseball cards just a hobby for adolescent children idolizing their sports heroes. Card collecting is big business evidenced by the price for a rookie Nolan Ryan card being several thousand dollars. Card collection conventions are held throughout the United States wherein adults as well as children buy, trade and sell their collections of cards for considerable amounts of money. College students have even been known to support themselves through the buying and selling of baseball cards.

It is common knowledge within the card collecting community that the older the card, the more valuable it is. Some of the more valuable cards are of the baseball superstars of the 1940s and 1950s, such as Ted Williams and Joe DiMaggio. The storage and protection of these valuable commodities is of great interest to card collectors. A card which has been water damaged, bent, torn, faded, or has had the edges rolled or frayed, is greatly depreciated in value. The card collecting hobby even has its own array of magazines which often include articles on the safe storage of card collections. Much opinion has even been given to the utilization of PVC or polyvinylchloride sheets for storing such cards since there is some evidence that over time the PVC sheets undergo a chemical reaction releasing hydrochloric acid which deteriorates the cards.

Previously, card collectors have stored their collections in shoeboxes, photo albums and any other unused container available around the house. The problem associated with photo albums has been previously mentioned in relation to the utilization of clear PVC sheets within the photo albums. Shoeboxes and the like do not provide a good, safe environment for the protection of cards since moisture can enter the boxes, the jumble of cards rub against each other damaging their finish and cards become bent under their own weight when stacked upon each other. Even the utilization of file boxes used for index cards or recipes does not provide the proper safety needed to protect the cards since a user then must thumb across the top of the cards looking for the one he or she desires. This tends to bend the top edges of the cards. The dividers within such storage devices are not rigidly held within the inside, thus the cards are still susceptible to bending and having their finish damaged since the cards remain stacked against each other resulting in friction contact between them.

Therefore, what is needed in the art is a storage device for card collections which allows the collector to file his or her cards in any order desired, but also provides an environment for the collection that protects the cards against damage from either rubbing against each other or being stacked against each other resulting in the bending of the cards and the fraying of their edges.

A further need exists in the art for a storage device for card collections which allows the user to transport the storage device to and from card collection conventions without the risk of the cards becoming damaged in transit.

A further need exists in the art for a card collection storage system which allows the cards to be maintained upright without undue friction between them and which allows the cards to be removed, or inserted, without damage.

SUMMARY OF THE INVENTION

These and other problems have been solved with a storage device and system for card collections which includes a finger gripping area near the top of each card and which has removable dividers rigidly placed within the storage device so that the sports cards do not substantially rub against each other or bend under their own weight. Opposing guides are provided within the storage box for accepting the edges of the dividers to hold them firmly in place. The dividers may be arranged within the storage box in any manner desired providing many options as to the amount of space allocated between such dividers. The guides are formed within a recessed shoulder portion on each side of the box so that the guides do not damage the cards by coming in contact with the stored cards. It is this shoulder portion which also allows a user to insert his or her fingers to remove or insert a card from anywhere within the box.

The storage box may be fitted with either a hinged or sliding lid to securely enclose the card collection within the storage box. This lid can provide a watertight seal for the prevention of moisture damage to the stored collection. Additionally, the interior bottom of the storage box may be fitted with a soft, padded material and/or a drainage system to further prevent damage to the edges of the stored cards.

A still further technical advantage of our storage device is the ability for several storage boxes to be interlocked in a side-by-side manner so as to provide for an organized presentation of the enclosed cards, and also to provide a firm and stable structure when the boxes are kept in storage themselves. This arrangement minimizes the opportunity for the separate boxes to be turned over or rolled resulting in the cards being damaged.

A still further technical advantage of our storage device is the recessed shoulder portions on each side of the box which allow a user to remove or insert cards from the box by touching only the top edges of the card and not having to touch the cards on their faces thereby preventing the deposits of oil and dirt onto the card faces from the hands of the user. The recessed shoulder portions also support the guides for receiving the dividers which prevents the individual guides from damaging the cards.

The foregoing has outlined rather broadly the features and technical advantages of the present invention in order that the detailed description that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 illustrates a perspective view of the card collection storage device;

FIG. 2 illustrates a cross-sectional view of the storage device;

FIG. 3 illustrates the manner in which several storage devices may be interlocked.

DETAILED DESCRIPTION OF THE INVENTION

Figure 4:
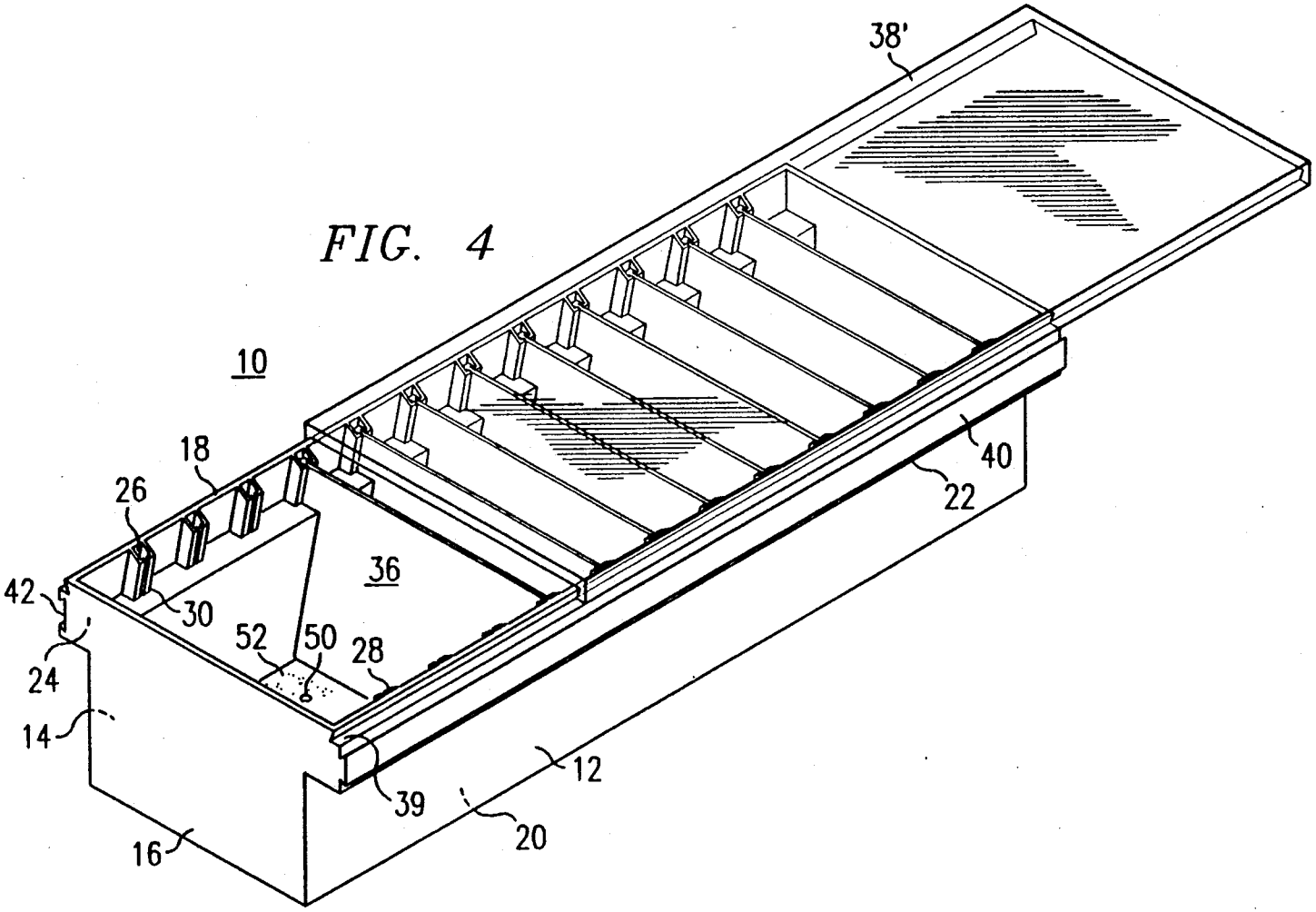
FIG. 4 illustrates various options available on the storage device.

Turning first to FIG. 1, there is illustrated a perspective view of a card collection storage box 10. Box 10 has two opposing sides 12 and 14 each having length "1", two opposing ends 16 and 18 each having width "w" and a bottom 20 containing area "w" ×"1". Sides 12 and 14 have open recessed shoulders 22 and 24 positioned towards the top of sides 12 and 14. Shoulders 22 and 24 have a height ("h") from bottom 20. Height "h" is calculated to be less than the height (as measured from the bottom of the box) of a typical card 36. Thus, as depicted in FIG. 2, when a card 36 is placed on its side within box 10, card 36 will project above recessed shoulders 22 and 24 easily allowing a user to use his or her fingers to insert or remove card 36. On the interior portions of shoulders 22 and 24 are, in one embodiment, placed evenly spaced opposing guides 26 and 28. Note that the cards may be designed to be stored on their side edges as shown or on their bottom edges. The relative dimensions of the box can be adjusted as desired.

Returning to FIG. 1, divider 34 may be inserted between any two opposing guides 26, 28 within box 10 so as to provide the user numerous options on the spacings between each divider 34. When inserted, divider 34 is held in place between guides 26 and 28 by overlapping lips 30 integrally formed with each guide. Each guide 26 and associated lip 30 mates with each flanged edge 32 of divider 34. Thus, guides 26 and 28 with associated lips 30 pilot divider 34 with associated flanged edges 32 into positions within box 10. Divider 34 advantageously has width "x" which is slightly less than dimension "w" to facilitate easy removal and placement. In a preferred embodiment, flanged edge 32 and lips 30 are not used and divider (partition) 34 remains in place because of the mechanical overlapping of the guides and the dividers With the various dividers 34 in place within box 10, the user may then arrange the card collection 36 as desired. A lid 38 may be hinged, by hinge 21, to box 10 to cover the open top and protect the enclosed cards 36. Referring to FIG. 4, lid 38 may be slidably attached to box 10 instead of hinged and may be transparent so that the user may view the card collection 36 without opening lid 38. Lid 38 may also provide a watertight seal (not shown) with box 10 to prevent moisture from entering Such a seal can be, for example, a gasket extending around the rim of the box. Or the gasket can be integral to the lid, if desired. In addition, interior bottom 20 of box 10 may be padded with a soft material 52, such as sponge, foam rubber, leather or the like to further protect the edges of the card collection 36 from such drain hole 50 can be flanged to allow moisture to pass out only. In a preferred embodiment, lid 38 can have a flange (not shown) which folds over upper side edge 39. Protrusions (not shown) can be positioned along edge 39 to force fit with lid 38 to help maintain lid 38 closed. Additionally, each divider 36 and guides 26 and 28 may be positioned within box 10 so that divider 36 is angled with respect to bottom 20.

Referring again to FIG. 1, divider is firmly held in place between guides 26 and 28, and not allowed to move within box 10, so as to provide definite storage compartments for card collection 36. With this configuration, card collection 36 is not allowed to stack up under its own weight and the weight of divider 34 preventing the possibility of damage to card collection 36.

Turning next to FIG. 2, there is illustrated a cross-sectioned view of box 10 emphasizing how recessed shoulders 22 and 24 prevent each guide 26 and 28 from contacting the card collection 36, yet firmly position each divider 34 within box 10. As a result, damage to the edges of the cards 36 from contact with guides 26, 28 is prevented. It should be stressed that any damage to a card 36 lowers its market value.

Several storage boxes 10 may be interlocked with each other by the utilization of dovetail joints 44 as illustrated in FIG. 3. Referring back to FIG. 2, there is shown box 10 wherein one shoulder 22 of one side 12 is integrally formed with tenon 40 and the opposite shoulder 24 of the other side 14 is integrally formed with mortise 42. Thus, when two or more boxes 10 are interlocked side-by-side as illustrated in FIG. 3, the connection is made by the interlocking of tenon 40 of one box 10 to mortise 42 of a second box 10 forming dovetail joint 44. Obviously, other variations in connecting boxes 10 are available, such as the utilization of a "hook and loop" fastening arrangement (i.e. "Velcro") wherein tenon 40 is replaced with the "hook" material and mortise 42 is replaced with the "loop" material.

Additionally, storage boxes 10 may be connected together in an end-to-end manner (not shown) resulting in an expansion of the interior storage space along its lateral plane. This can be accomplished by removing end 16 from two boxes 10 and connecting the two boxes together forming an elongated box 10.

As an added precaution against damage to the stored card collection 36, box 10 and its various components may be formed of a plastic material that does not contain polyvinylchloride which has been suspected of deteriorating cards over time.

Although the present invention and its advantages have been described in detail, it should be understood that various changes, substitutions and alterations can be made herein without departing from the spirit and scope of the invention as defined by the appended claims.

What is claimed is:

1. A box comprising:

two opposing end portions, each having width "w";

two opposing side portions, each having length "l"; and each extending from one edge of one of said end portions to one edge of said opposing end portion so as to form a parallelogram;

a bottom portion having width "w" and length "l" and extending interiorly from said opposing end portions and said opposing side portions;

at least one shelf portion extending in a direction away from said interiorly extending bottom along its entire length along at least one of said side portions, said shelf portion overhanging said side portion in a direction away from said interiorly extending bottom, said shelf portion connected to an extension of said end portions, said end portion extension being outside said width "w", wherein said shelf portion includes means for positionally removing partitions between said side portions at selected positions along said length "l" of said side portions, wherein said partitions have a first portion which is supported on said shelf portion and a second portion which hangs down between said side portions.

2. The box as set forth in claim 1 further comprising:

a lid for enclosing said box.

3. The box as set forth in claim 1 further comprising:

means for interlocking a plurality of said boxes in a side by side manner.

4. A box for storing card collections, said box having two sides, two ends, a bottom and an open top portion comprising:

opposing guides disposed in each side of said box, said guides adapted for removably placing one or more dividers between said opposing guides in said sides, wherein said card collections can be stored between said dividers within said box, and wherein each of said guides are a pair of L-shaped members extending from said sides for capturing each end of said dividers for preventing ends of said dividers from being displaced away from said opposing guides towards a center of said box, wherein said sides include recessed portions directed away from said center of said box, said recessed portions positioned towards a top of said sides, each of said recessed portions comprising:

a first wall coupled to one of said sides in a substantially perpendicular manner, and a second wall coupled in a substantially perpendicular manner to said first wall, wherein said guides are inset within said recessed portions so as to prevent contact between said guides and stored ones of said card collections, each of said guides coupled to said second wall.

5. The box of claim 4 further comprising:

a lid connected to said open top portion for enclosing said box.

6. The box of claim 5 wherein said lid is hinged to said box.

7. The box of claim 5 wherein said lid is slidably connected to said box.

8. The box of claim 5 wherein said lid is transparent.

9. The box of claim 4 wherein said opposing guides are evenly spaced along said sides.

10. The box of claim 4 wherein said divider may be placed within said guides in various combinations to provide various sized storage spaces within said box.

11. The box of claim 4 further comprising:

means for interlocking a plurality of said boxes in a side-by-side manner.

12. The box of claim 11 wherein said interlocking means includes:

a portion of one exterior side of said box forming a tenon; and a portion of the opposite exterior side of said box forming a mortise, wherein said tenon on a first box mates with said mortise on a second box for fastening said plurality of boxes in a side-by-side manner.

13. The box of claim 4 wherein said divider are positioned between said guides at a non-perpendicular angle to said bottom of said box.

14. The box of claim 4 wherein said bottom is padded.

15. The box of claim 4 wherein said bottom allows for the drainage of liquids away from stored ones of said card collections.

* * * * *